US007895677B1

(12) United States Patent
Schiebl

(10) Patent No.: US 7,895,677 B1
(45) Date of Patent: Mar. 1, 2011

(54) CHIN GUARD WITH BUMPED CONTACT SURFACE

(76) Inventor: Paul Schiebl, Houston, TX (US)

( * ) Notice: Subject to any disclaimer, the term of this patent is extended or adjusted under 35 U.S.C. 154(b) by 890 days.

(21) Appl. No.: 11/761,289

(22) Filed: Jun. 11, 2007

Related U.S. Application Data

(63) Continuation-in-part of application No. 11/222,283, filed on Sep. 8, 2005, now Pat. No. 7,735,160, which is a continuation-in-part of application No. 10/463,774, filed on Jun. 16, 2003, now abandoned.

(51) Int. Cl.
*A42B 7/02* (2006.01)

(52) U.S. Cl. ..... 2/421

(58) Field of Classification Search ..... 2/421, 411, 2/414, 425, 412, 417, 418, 422, 9, 410
See application file for complete search history.

(56) References Cited

U.S. PATENT DOCUMENTS

| | | | | |
|---|---|---|---|---|
| 2,867,811 | A * | 1/1959 | Jones | 2/421 |
| 3,619,813 | A * | 11/1971 | Masrchello | 2/421 |
| 4,741,054 | A * | 5/1988 | Mattes | 2/421 |
| 5,794,274 | A * | 8/1998 | Kraemer | 2/421 |
| 5,946,735 | A * | 9/1999 | Bayes | 2/421 |
| 6,298,483 | B1 | 10/2001 | Schiebl et al. | |
| 6,481,024 | B1 * | 11/2002 | Grant | 2/421 |
| 6,499,139 | B1 * | 12/2002 | Brown et al. | 2/9 |
| 6,499,147 | B2 | 12/2002 | Schiebl et al. | |

* cited by examiner

*Primary Examiner* — Tejash Patel
(74) *Attorney, Agent, or Firm* — Egbert Law Offices PLLC

(57) ABSTRACT

A chin guard has a shell with a cup suitable for fitting upon a human chin and a resilient layer received within the cup of the shell. The resilient layer has a periphery overlying the outer peripheral edge of the shell. The resilient layer has an interior surface opposite the shell. The interior surface has bumps formed thereon and extending substantially over an entirety of the interior surface. A netting material is affixed to the resilient layer and extends around the bumps.

18 Claims, 3 Drawing Sheets

CHIN GUARD WITH BUMPED CONTACT SURFACE

CROSS-REFERENCE TO RELATED U.S. APPLICATIONS

The present application is a continuation-in-part of U.S. application Ser. No. 11/222,283, filed on Sep. 8, 2005 and entitled "Chin Guard Apparatus for use with a Helmet", presently pending. U.S. application Ser. No. 11/222,283 is a continuation-in-part of U.S. patent application Ser. No. 10/463,774, filed on Jun. 16, 2003, and entitled "Helmet Chinstrap", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to chin guards for use with helmets. More particularly, the present invention relates to chin guards that have protective cups associated therewith for protection of the chin of the wearer. More particularly, the present invention relates to chin guard apparatus that have a single resilient layer extending across an interior surface of the protective cup.

2. Description of Related Art Including Information Disclosed Under 37 CFR 1.97 and 37 CFR 1.98.

The invention relates to improvements in protective headgear such as football helmets, motorcycle and bicycle helmets, and helmets for other activities where protection from head impact and injury is desirable. The invention also relates to protective pads, particularly chin pads.

Protective helmets to minimize head injuries have been known and used for many years. For example, football helmet shells have been produced from injection molded ABS, or polycarbonate plastic. Helmets intended for youth usage have usually been produced from ABS plastic, and helmets for adult usage have usually been produced from polycarbonate plastic. ABS plastic is significantly less expensive than polycarbonate, but ABS plastic is not as structurally rigid as polycarbonate. As the level of intensity of contact in youth football is significantly lower than that at the adult level, ABS has been accepted as a satisfactory material for use at the youth level. For adult helmets, however, the structural rigidity of the polycarbonate material is essential to minimize the flex and deformation of the shell under extreme impact conditions.

The National Operating Committee on Standards for Athletic Equipment (NOCSAE) has been responsible for setting minimum performance criteria for football helmets. The minimum standard acceptance level measured by the Severity Index (IS) is set at 1200. Through the continuous testing of NOCSAE, it has been established that the rigidity of polycarbonate shells, in comparison to ABS shells, leads to significantly lower IS results. From these tests, it is believed that there is a correlation between the rigidity of the shell material and improved safety performance.

Protection can also be improved by the addition of a face mask attached to the helmet. For example, football helmets are usually equipped over the exposed face area with a vinyl coated wire or other metal structure, or an injection molded plastic face mask. The obvious purpose of the face mask is to protect the face of the player from injury, while not obstructing the player's vision unnecessarily. The addition of a face mask can also increase the rigidity of the shell which improves the IS performance. Helmets are usually tested without face masks so that the IS performance of a helmet with the mask will somewhat exceed the test standard.

Face masks have been mounted to the exterior surface of the helmet shell behind the front edge of the helmet face opening. This design can, under certain conditions, contribute to serious injury. Helmet shells are specifically designed with smooth spherical surfaces to allow the shells to glance and slide on impact.

Protective helmets usually include a chin strap to retain the helmet, particularly during impact. In the past, chin straps were frequently constructed using a molded plastic cup made of compression or injection-molded plastic material. A pad, usually of a felt or foam material, was bonded or otherwise attached to the plastic cup. This cup construction is preferable to non-padded chin straps which have been standard equipment on football helmets. Non-padded chin straps do not offer any impact protection to the chin area, and only serve to secure the helmet to the player's head. Padded chin cups provide an added measure of protection to the chin from impacts, in addition to securing the helmet to the player's head.

Improvement in the impact absorption performance of padded chin straps is desirable. Most molded plastic chin cups currently used are molded in a manner which allows the formed cup to flex upon impact. An improved construction is a rigid material which does not flex on impact to an undesirable degree, thus distributing the impact force over a larger area of the chin.

The present inventor is the owner of U.S. Pat. No. 6,298,493, issued on Oct. 1, 2001 to Schiebl et al. U.S. Pat. No. 6,298,493 describes a protective headgear that comprises a rigid shell with face pads that can be released and removed while the headgear is still on a person's head. A protective chin guard is attached to the headgear by way of the face pads. The chin guard includes a substantially rigid shell with a removable insert made of a flexible bladder filled with a shock-absorbing fluid. The headgear includes a shell made of an inner and outer material layered over an internal foam core to effect both strength and light weight construction.

The cup associated with the protective shell of the chin strap often has had an imperfect fit with the wearer's chin. In certain circumstances, the user may desire to have enhanced protection against impacts. The wearer may also desire a more comfortable fit with the cup of the shell of the protective chin strap and more comfortable contact between the chin and an interior surface of the chin guard. Often, the cup of the chin strap has a peripheral edge which bears against the skin of the user. In the event of an impact, this edge can bruise the chin of the user. In the event of a severe impact, the peripheral edge of the protective shell of the chin strap can cause adverse impacts to the face of the user. As such, a need has developed whereby the edge of the shell of the cup of the chin strap be fully cushioned and protected from the skin of the wearer.

It is an object of the present invention to provide a chin guard apparatus which maximizes the protection and comfort of the user.

It is another object of the present invention to provide a chin strap apparatus which enhances the degree of protection against the peripheral edge of the rigid shell of the cup of the chin guard apparatus.

It is a further object of the present invention to provide a chin guard apparatus whereby the cushion of the cup can be adapted to properly fit the facial configuration and desires of the user.

It is another object of the present invention to provide a chin guard apparatus that enhances shock absorption on the exterior surface of the protective shell of the chin guard.

It is still a further object of the present invention to provide a chin guard apparatus to provide air circulation and comfortable contact with the skin of the user.

It is another object of the present invention to provide a chin guard apparatus that is relatively inexpensive, easy to manufacture and easy to assemble.

It is a further object of the present invention to provide a chin guard device that enhances moisture management within the interior of the chin guard.

These and other objects and advantages of the present invention will become apparent from a reading of the attached specification and appended claims.

BRIEF SUMMARY OF THE INVENTION

The present invention is a chin guard apparatus for use with a helmet. This chin guard has a shell with a cup suitable for fitting upon a human chin. The shell has an outer peripheral edge. A resilient layer is received within the cup of the shell. This resilient layer has a periphery overlying the outer peripheral edge of the shell. The resilient layer has an interior surface with bumps formed substantially over an entirety of the interior surface.

In the present invention, the resilient layer is in surface-to-surface contact with a surface of the shell. A netting material is affixed to the interior surface of the resilient layer and around the bumps. The netting material resides in the channels extending between adjacent bumps. As used herein, the term "netting material" can refer to netting and to fabric elements extending through the channels between the adjacent bumps.

The shell has a plurality of through holes formed in the cup. Additionally, the resilient layer has a plurality of through holes formed therein so as to align with the through holes of the shell. The cup also has at least one opening formed generally centrally of the cup. In the preferred embodiment, the cup has a pair of generally semicircular openings formed generally centrally of the cup.

The outer peripheral edge of the shell is flanged outwardly of the cup. The periphery of the resilient layer extends over and beyond the outer periphery of the shell. The resilient layer is formed of a foamed polymeric material. The shell is formed of a rigid polymeric material. The shell has a first slot formed on one side thereof and a second slot formed on an opposite side thereof. The resilient layer has a channel formed on opposite sides thereof so as to overlie the first and second slots.

DETAILED DESCRIPTION OF THE INVENTION

Figure 1:
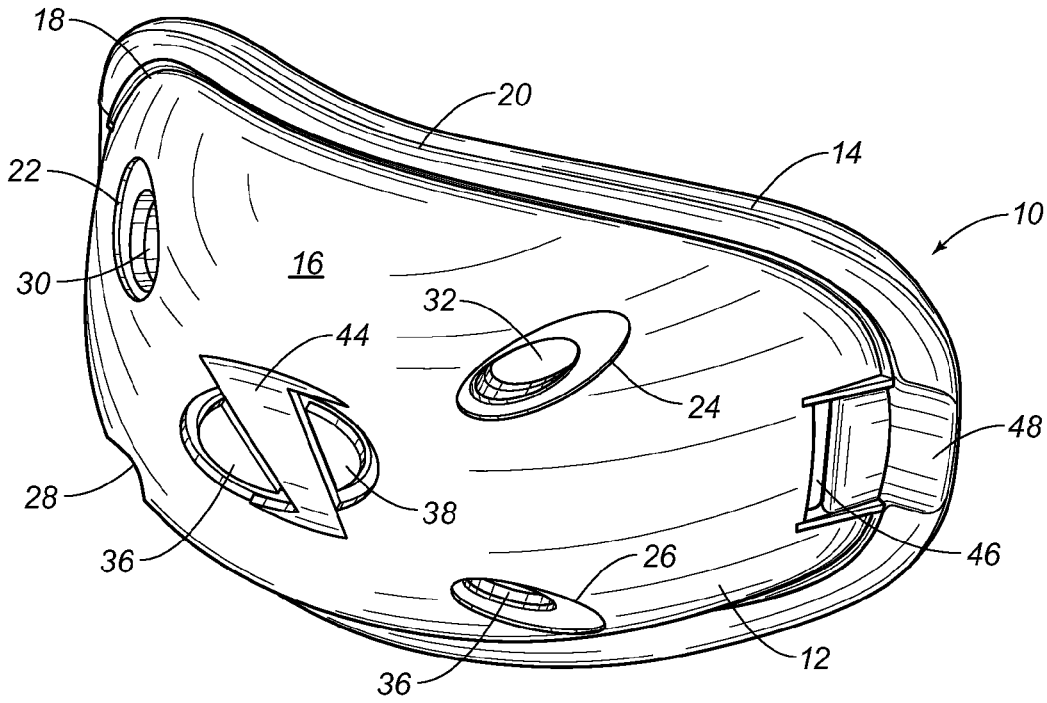
FIG. 1 is a perspective view of the chin guard in accordance with the preferred embodiment of the present invention.

Referring to FIG. 1, there is shown the chin guard 10 in accordance with the preferred embodiment of the present invention. The chin guard 10 includes a shell 12 and a resilient layer 14. The shell 12 has a cup 16 suitable for fitting upon a human chin. The shell has an outer peripheral edge 18 that extends therearound and extends outwardly of the outer periphery of the cup 16. The resilient layer 14 is received within the cup 16 of shell 12. The resilient layer 14 has a periphery 20 which overlies the outer peripheral edge 18 of the shell 12.

As can be seen in FIG. 1, the shell 12 is formed of a rigid polymeric material. Holes 22, 24, 26 and 28 are formed through the shell 12 so as to allow air circulation to contact the chin of the user. Similarly, as will be described hereinafter, the resilient layer 14 also includes holes 30, 32 and 34 which are aligned with the through holes 22, 24 and 26, respectively, of the shell 12. This arrangement of aligned holes ensures proper air circulation to the chin of the wearer.

The shell 12 also includes a first generally semi-circular opening 36 and a second semi-circular opening 38 formed centrally of the cup 16. A bumper member 44 is received between the semi-circular openings 36 and 38 so as to extend thereacross. Bumper member 44 can provide shock absorbency at the very center of the shell 12. The bumper member 44 can be formed of a rubber or elastomeric material.

The shell 12 includes a slot 46 formed on one side and another slot formed on the opposite side. The slot 46 is suitable for receiving the strap which serves to connect the chin guard 10 to a helmet. A suitable channel 48 can be formed on the resilient member 14 generally adjacent to the slot 46 so as to provide a suitable guide for the chin strap extending thereacross.

The shell 12 is formed of a rigid polymeric material while the resilient layer 14 is formed of a foamed polymeric material. Since there are only two main components of the chin guard 10 of the present invention, the chin guard 10 can be assembled in an easy manner. Additionally, the manufacturing costs associated with forming the chin guard 10 of the present invention are minimal. These goals can be accomplished while, at the same time, providing maximum protection to the wearer of the chin guard. Since the resilient layer 14 overlies the outer peripheral edge 18 of the shell 12, sharp contacts between the outer peripheral edge 18 of the shell 12 and the face of the wearer are effectively cushioned.

Figure 2:
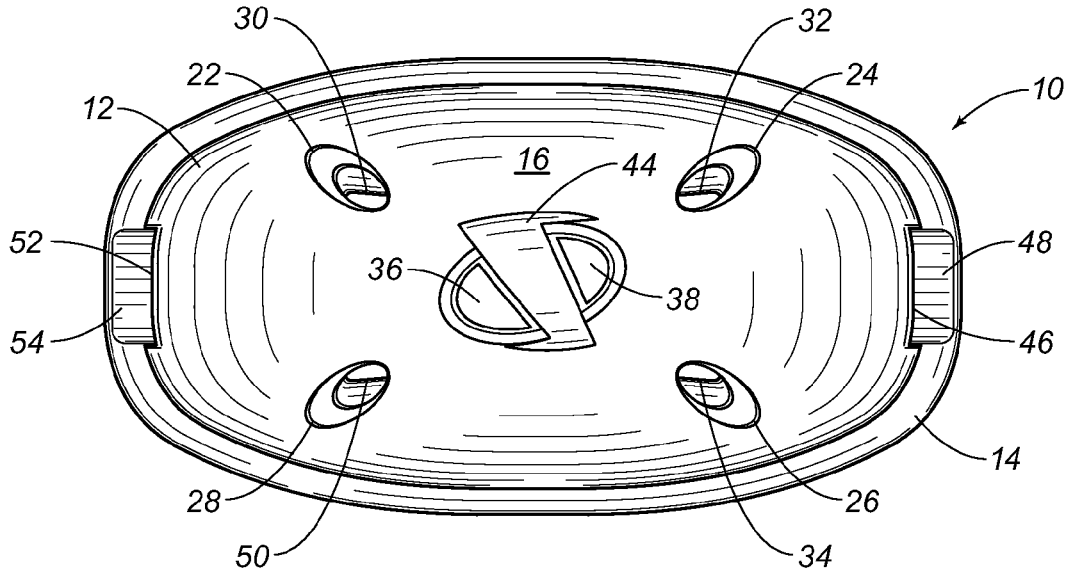
FIG. 2 is a frontal view of the chin guard of the present invention.

FIG. 2 shows a front view of the chin guard 10 of the present invention. In FIG. 2, the holes 22, 24, 26 and 28 are fully illustrated. Each of these holes 22, 24, 26 and 28 has a generally oval or oblong configuration. The respective holes 30, 32, 34 and 50 of the resilient layer 14 are illustrated as aligned with the respective holes 22, 24, 26 and 28. The oval nature of the holes 22, 24, 26 and 28 assures full air circulation to the wearer even in the event that the resilient layer 14 has shifted slightly out of position. The semi-circular openings 36 and 38 are illustrated as located within the center of the cup 16 of shell 12. The bumper member 44 has a generally reverse Z-shaped configuration. The slot 46 is formed on side of the shell 12 while the slot 52 is formed on the opposite side of the shell. Channel 48 is aligned with the slot 46 on one side of the shell 12. A channel 54 is aligned with the slot 52 on the opposite side of the shell 12. Channels 48 and 54 are formed in the edge surface of the resilient layer 14 which overlies the outer peripheral edge 18 of the shell 12.

Figure 3:
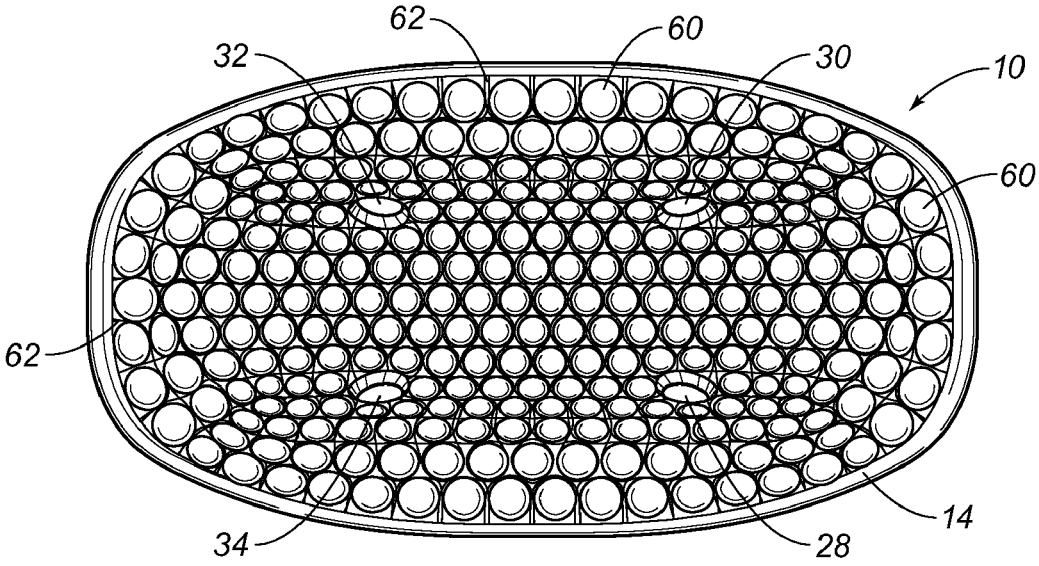
FIG. 3 is a back view of the chin guard of the present invention.

FIG. 3 illustrates the interior of the chin guard 10 of the present invention. In FIG. 3, the resilient layer 14 is particularly illustrated. The resilient layer 14 has bumps 60 formed substantially over the entirety of the interior surface of the resilient layer 14. These bumps 60 are in the nature of small projections that extend outwardly from the support surface of the resilient layer 14. The extensive array of bumps 60 defines small channels therebetween. A netting material 62 is affixed over the support surface of the resilient layer 14 and around each of the bumps 60. The netting material 62 will extend through the small channels between bumps 60. The netting material 62 will also surround each of the bumps 60. The netting material 62 facilitates the ability to form the bumps 60 associated with the resilient layer 14. The netting material 62 also enhances the moisture management within the interior of said chin guard 10. In other words, the fabric or netting material will wash away sweat and moisture from the chin of the user. The netting material is of a water-absorbent fabric material. Since the resilient layer 14 is formed of a foamed polymeric material, the bumps 60 will be extremely soft. The bumps 60 are arranged so as to conform with the various configurations of the human chin. Additionally, the small channels that are formed between each of the bumps 60 allows airflow to pass easily through and between the bumps 60 so as to facilitate air circulation around the human chin. A compression of the bumps will create a "pumping" effect so as to draw air into and out of the space between the chin of the user and the resilient layer 14. The bumps 60 also serve to enhance the shock absorbency of the resilient layer 14. Whenever a contact occurs with the outer shell 12 of the chin guard 10 of the present invention, the bumps 60 will compress individually in those areas of maximum force against the chin. As such, the arrangement of the various bumps 60 will distribute the forces of the impact over a wider area. It has been found that the arrangement of the bumps 60 of the present invention avoids the problems associated with ingrown hairs. The air circulation causes this improvement since the flow of air will generally keep the face from breaking out. As such, bumps 60 of the resilient layer 14 enhance the comfort of present invention. Openings are formed in the resilient layer 14 corresponding to the through holes 28, 30, 32 and 34 associated with the shell 12. As such, these openings enhance the ability for air circulation to occur between the bumps 60 and the human chin. Furthermore, the arrangement of the bumps has been found to avoid any slippage of chin guard 10 from a desired position on the human chin.

Figure 4:
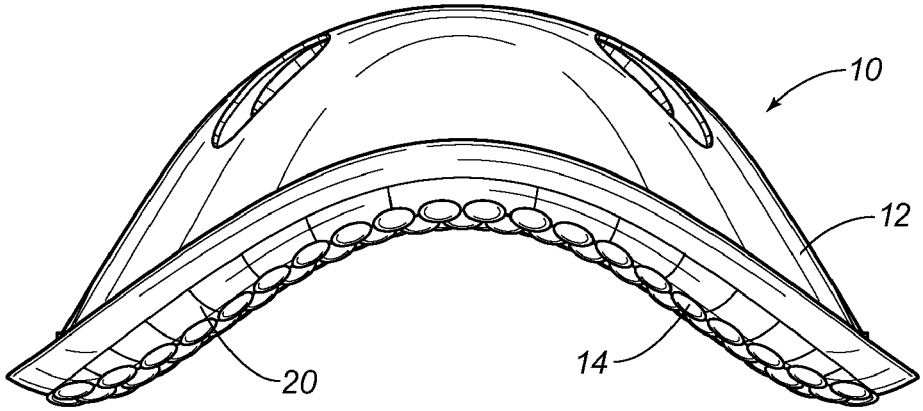
FIG. 4 is a side elevational view of the chin guard of the present invention.

FIG. 4 illustrates a plan view of the chin guard 10 of the present invention. In FIG. 4, it can be seen that the resilient layer 14 has a peripheral surface 20 which overlies and extends rearwardly over the outer peripheral edge 18 of the shell 12. This lengthy overlying relationship assures a protective cushioning effect against any sharp edges of the rigid shell 12.

Figure 5:
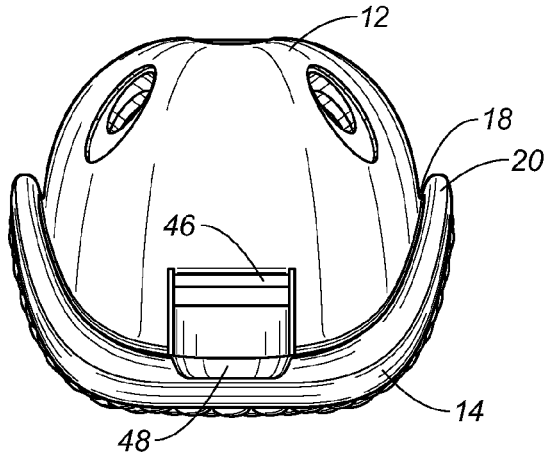
FIG. 5 is an end view of the chin guard of the present invention.

In FIG. 5, the resilient layer 14 is further illustrated as having its outer periphery 20 extending over and beyond the outer peripheral edge 18 of the shell 12 on opposite sides of the shell 12. The channel 48 is illustrated as formed in surface of the outer periphery 20 of the resilient layer 14 so as to generally align with the slot 46 formed in the shell 12.

Figure 6:
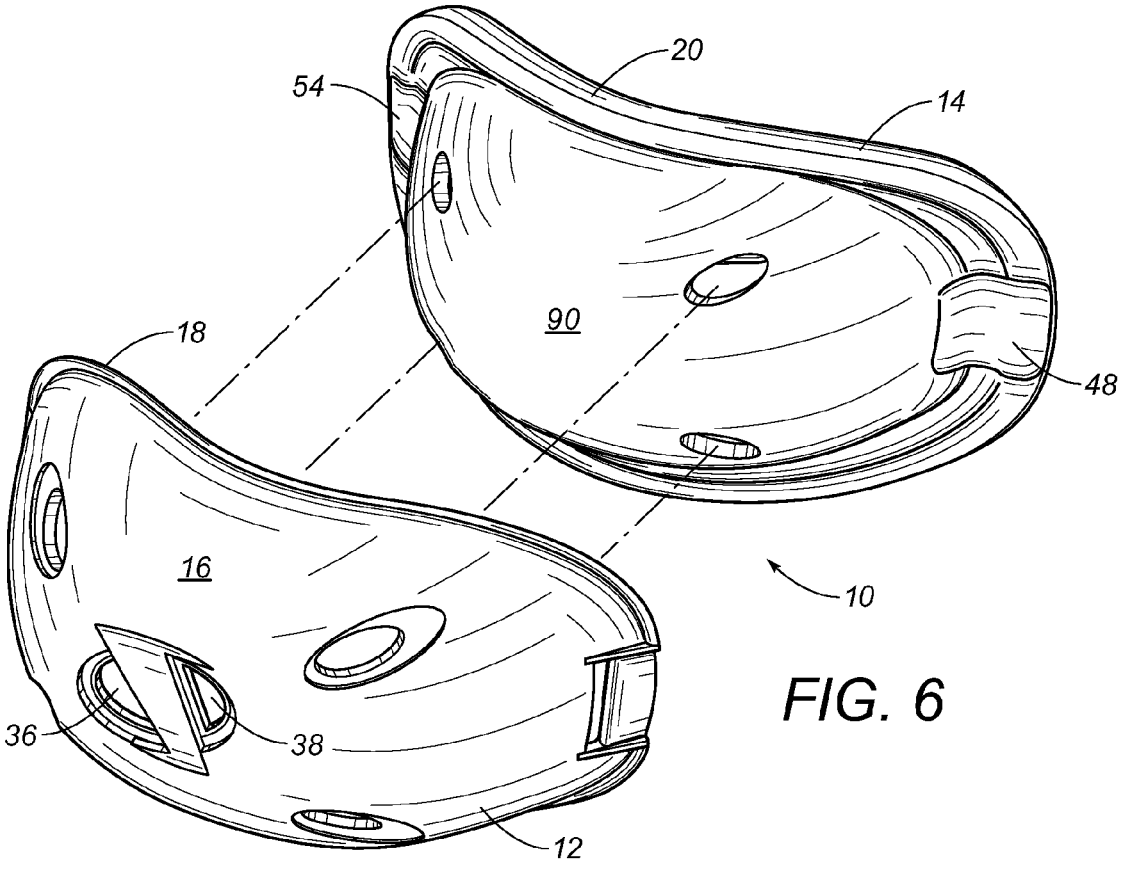
FIG. 6 is an upper perspective exploded view of the chin guard of the present invention.

FIG. 6 illustrates the manner in which the resilient layer 14 is received within the shell 12 of the chin guard 10 of the present invention. In FIG. 6, the shell 12 has cup 16 which serves to receive the cup area 90 of the resilient layer 14. FIG. 6 shows that the through holes of the resilient layer 14 are aligned with the through holes of the shell 12. The shell 12 is illustrated as having its outer peripheral edge 18 slighted flanged outwardly of the shell 12. The outer peripheral edge 20 has a suitable size so as to completely cover this outer peripheral edge 18 and to provide effective protection against sharp impacts caused by the outer peripheral edge 18 against the face of the wearer. The resilient layer 14 is illustrated as having a channels 48 and 54 formed on opposite sides thereof so as to align with the strap-receiving slots formed on the shell 12. These surfaces provide a guide for the strap which emanates through the slots on the shell 12.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A chin guard comprising:

a shell having a cup suitable for fitting upon a human chin, said shell having an outer peripheral edge;

a resilient layer received within said cup of said shell, said resilient layer having a periphery overlying said outer peripheral edge of said shell, said resilient layer having an interior surface opposite said shell, said interior surface having bumps formed thereon and extending substantially over an entirety of said interior surface; and a netting material affixed to said resilient layer and extending around said bumps.

2. The chin guard of claim 1, said resilient layer being in surface-to-surface contact with a surface of said shell, said bumps being integrally formed with said resilient layer.

3. The chin guard of claim 1, said bumps defining channels therebetween, said netting material extending through said channels.

4. The chin guard of claim 1, said resilient layer being formed of a foamed polymeric material.

5. A chin guard comprising:

a shell having a cup suitable for fitting upon a human chin, said shell having an outer peripheral edge; and a resilient layer received within said cup of said shell, said resilient layer having a periphery overlying said outer peripheral edge of said shell, said resilient layer having an interior surface opposite said shell, said interior surface having bumps formed thereon and extending substantially over an entirety of said interior surface, said shell having a plurality of through holes formed in said cup, said resilient layer having a plurality of through holes formed therein and aligned with said plurality of through holes of said shell.

6. The chin guard of claim 5, said outer peripheral edge of said shell being flanged outwardly from said cup, said periphery of said resilient layer extending over and beyond said outer peripheral edge of said shell.

7. The chin guard of claim 5, said shell being of a rigid polymeric material.

8. The chin guard of claim 5, said shell having a first slot formed on one side thereof and a second slot formed on an opposite side thereof, said first and second slots being suitable for receiving straps therethrough, said resilient layer having a channel formed on opposite sides thereof so as to overlie said first and second slots.

9. A chin guard comprising:

a resilient layer having a shape suitable for fitting over a human chin, said resilient layer having an interior surface with bumps formed thereon, said bumps extending adjacent to one another substantially over an entirety of said interior surface, said bumps defining channels extending therebetween; and a netting material affixed to said resilient layer and extending around said bumps.

10. The chin guard of claim 9, further comprising:

a shell affixed over an outer surface of said resilient layer.

11. The chin guard of claim 10, said shell having an outer peripheral edge, said resilient layer having a periphery overlying said outer peripheral edge.

12. The chin guard of claim 9, said netting material formed of a water-absorbent fabric material.

13. The chin guard of claim 10, said shell having a plurality of through holes formed in said cup, said resilient layer having through holes formed therein so as to align with said through holes of said shell.

14. The chin guard of claim 10, said outer peripheral edge of said shell being flanged outwardly from said cup, said periphery of said resilient layer extending over and beyond said outer peripheral edge of said shell.

15. The chin guard of claim 10, said resilient layer being of a foamed polymeric material, said shell being of a rigid polymeric material.

16. A chin guard comprising:

a shell having a cup suitable for fitting upon a human chin, said shell having an outer peripheral edge;

a resilient layer received within said cup of said shell, said resilient layer having a periphery overlying said outer peripheral edge of said shell, said resilient layer being in surface-to-surface contact with a surface of said shell, said resilient layer having bumps formed on a surface thereof opposite said shell, said outer peripheral edge of said shell being flanged outwardly of said cup, said periphery of said resilient layer extending over and beyond said outer peripheral edge of said shell, said bumps defining channels extending between adjacent bumps; and a netting material affixed to said resilient layer and extending along said channels.

17. The chin guard of claim 16, said bumps extending substantially over an entirety of said surface of said resilient layer opposite said shell.

18. The chin guard of claim 16, said netting material being of a water-absorbent fabric material.

* * * * *